US008991371B2

(12) United States Patent
Skinner et al.

(10) Patent No.: US 8,991,371 B2
(45) Date of Patent: Mar. 31, 2015

(54) IGNITION COIL

(75) Inventors: Albert A. Skinner, Waterford, MI (US); Harry O. Levers, Clarkston, MI (US); Andre V. Scaff, Lake Orion, MI (US)

(73) Assignee: Delphi Technologies, Inc., Troy, MI (US)

( * ) Notice: Subject to any disclaimer, the term of this patent is extended or adjusted under 35 U.S.C. 154(b) by 423 days.

(21) Appl. No.: 13/460,968

(22) Filed: May 1, 2012

(65) Prior Publication Data

US 2013/0291844 A1 Nov. 7, 2013

(51) Int. Cl.

| | |
|---|---|
| ***F02P 3/02*** | (2006.01) |
| ***H01F 38/12*** | (2006.01) |
| ***H01F 27/02*** | (2006.01) |

(52) U.S. Cl.

CPC ..... *H01F 27/022* (2013.01); *H01F 38/12* (2013.01)

USPC ..... 123/634; 336/96; 336/228

(58) Field of Classification Search

CPC ..... F02P 3/02; H01F 38/12; H01F 2038/12; H01F 2038/122; H01F 2038/127

USPC ..... 123/634; 336/92, 96, 228

See application file for complete search history.

(56) References Cited

U.S. PATENT DOCUMENTS

| | | | | |
|---|---|---|---|---|
| 7,190,249 | B2 * | 3/2007 | Maekawa et al. | 336/92 |
| 7,276,998 | B2 * | 10/2007 | Lotfi et al. | 336/90 |
| 7,882,828 | B2 | 2/2011 | Skinner et al. | |
| 2005/0134417 | A1 * | 6/2005 | Maekawa et al. | 336/92 |
| 2008/0150448 | A1 | 6/2008 | Lerchegger et al. | |
| 2010/0147275 | A1 * | 6/2010 | Stegmaier | 123/634 |

* cited by examiner

*Primary Examiner* — Erick Solis

(74) *Attorney, Agent, or Firm* — Thomas R Twomey

(57) ABSTRACT

An ignition coil for an internal combustion engine includes a magnetically-permeable core extending along a core longitudinal axis, the core having a pair of end surfaces on axially-opposite ends thereof. The ignition coil also includes a primary winding disposed outward of the core, a secondary winding disposed outward of the primary winding, and a structure comprising magnetically-permeable steel laminations having a base and a pair of legs, the structure defining a magnetic return path. The core is disposed between the pair of legs such that the core longitudinal axis extends through the legs and the end surfaces face toward the legs and at least one of the end surfaces of the core is spaced apart from a respective one of the legs to define an air gap. The structure is over-molded with an over-molding material such that the over-molding material fills at least a portion of the air gap.

19 Claims, 6 Drawing Sheets

IGNITION COIL

TECHNICAL FIELD OF INVENTION

The present invention relates to an ignition coil for developing a spark firing voltage that is applied to one or more spark plugs of an internal combustion engine.

BACKGROUND OF INVENTION

Ignition coils are known for use in connection with an internal combustion engine such as an automobile engine. Ignition coils typically include a primary winding, a secondary winding, and a magnetic circuit. The magnetic circuit conventionally may include a central core extending along an axis and located radially inward of the primary and secondary windings and magnetically coupled thereto. In one arrangement, a C-shaped high permeance structure is included to provide a high permeance magnetic return path. The high permeance structure may include a base section from which a pair of legs extends. The central core is placed between the legs such that the axis of the core extends through the legs of the high permeance structure and such that at least one end of the core is spaced apart from the leg to which it is adjacent to define an air gap. The primary winding, secondary winding, core and high permeance structure are contained in a case formed of an electrical insulating material. The case is filled with an insulating resin or the like for insulating purposes. In this configuration, insulating resin that fills the air gap may be subject to stress from the core during operation of the ignition coil. This stress may lead to undesired performance of the ignition coil.

What is needed is an ignition coil which minimizes or eliminates one or more of the shortcomings as set forth above.

SUMMARY OF THE INVENTION

Briefly described, an ignition coil for an internal combustion engine includes a magnetically-permeable core extending along a core longitudinal axis, the core having a pair of end surfaces on axially-opposite ends thereof. The ignition coil also includes a primary winding disposed outward of the core, a secondary winding disposed outward of the primary winding, and a structure comprising magnetically-permeable steel laminations having a base and a pair of legs, the structure defining a magnetic return path. The core is disposed between the pair of legs such that the core longitudinal axis extends through the legs and the end surfaces face toward the legs and at least one of the end surfaces of the core is spaced apart from a respective one of the legs to define an air gap. The structure is over-molded with an over-molding material such that the over-molding material fills at least a portion of the air gap.

BRIEF DESCRIPTION OF DRAWINGS

This invention will be further described with reference to the accompanying drawings in which.

DETAILED DESCRIPTION OF INVENTION

Figure 1:
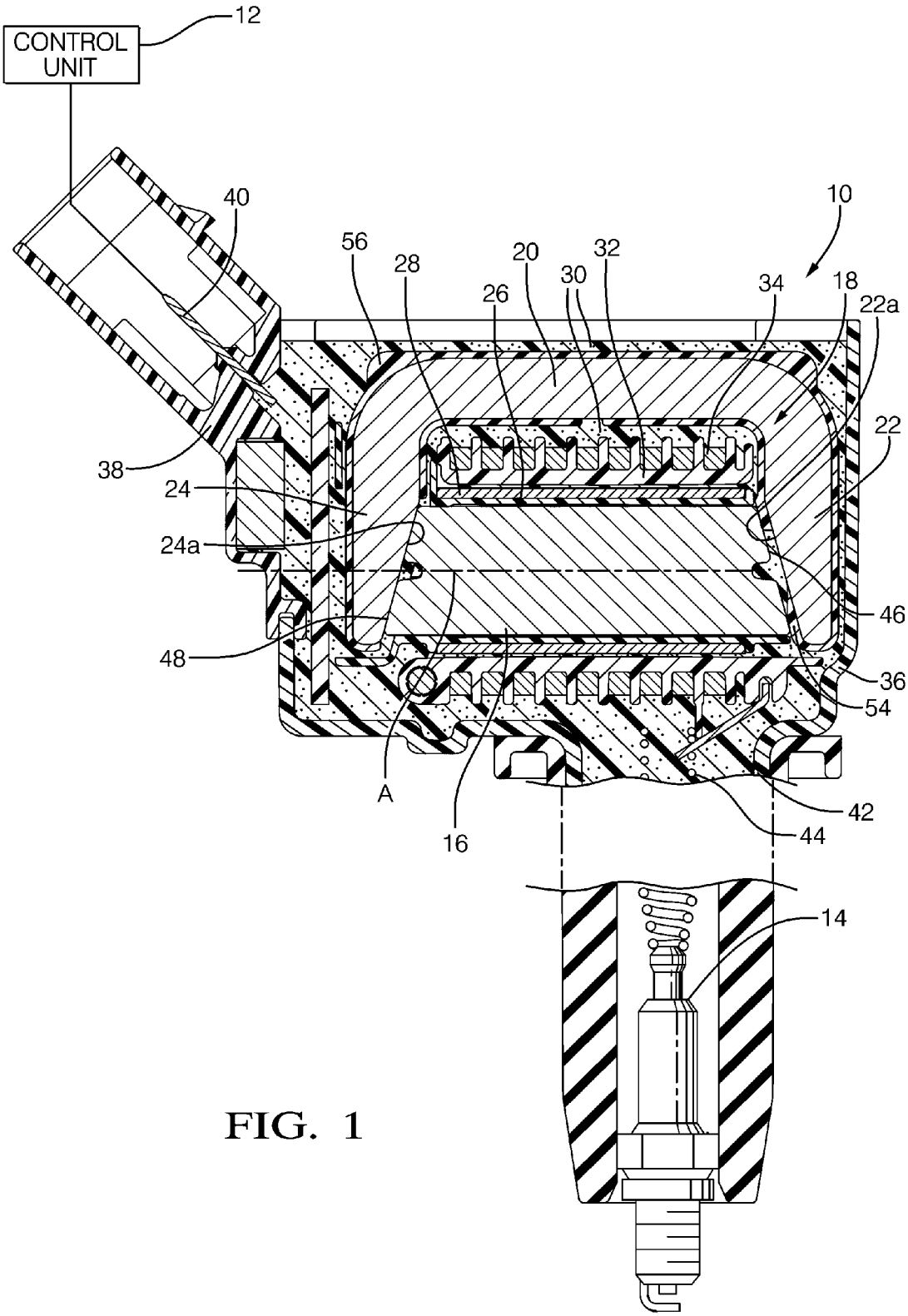
FIG. 1 is a simplified cross-section view of an ignition coil in accordance with the present invention.

Referring now to the drawings wherein like reference numerals are used to identify identical components in the various views, FIG. 1 is a simplified cross-section view of an ignition coil 10. Ignition coil 10 may be controlled by a control unit 12 or the like. Ignition coil 10 is configured for connection to a spark plug 14 that is in threaded engagement with a spark plug opening (not shown) in an internal combustion engine (also not shown). Ignition coil 10 is configured to output a high-voltage (HV) output to spark plug 14, as shown. Generally, overall spark timing (dwell control) and the like is provided by control unit 12. One ignition coil 10 may be provided per spark plug 14.

Ignition coil 10 may include a magnetically-permeable core 16, a magnetically-permeable structure 18 configured to provide a high permeance magnetic return path which has a base section 20 and a pair of legs 22 and 24, a primary winding spool 26, a primary winding 28, a quantity of encapsulant 30 such as an epoxy potting material, a secondary winding spool 32, a secondary winding 34, a case 36, a low-voltage (LV) connector body 38 having primary terminals 40 (only one primary terminal 40 is visible in the figures due to being hidden behind primary terminal 40 shown in FIG. 1), and a high-voltage (HV) tower 42 having a high-voltage (HV) terminal 44.

Figure 2:
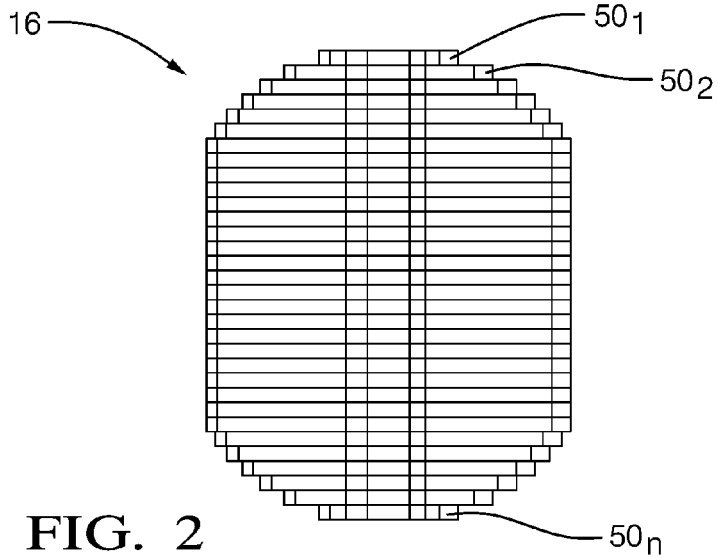
FIG. 2 is a radial cross-section view of a core of the ignition coil of FIG. 1.

Now referring to FIGS. 1 and 2, core 16 extends along a core longitudinal axis A and is generally oval in overall shape in radial cross-section as shown in FIG. 2, which is a radial cross-section view of core 16. Core 16 includes an upper end surface 46 at one axial end and a lower end surface 48 at the other axial end which is opposite of upper end surface 46. Core 16 may comprise laminated steel plates $\mathbf{50}_1$, $\mathbf{50}_2 \ldots \mathbf{50}_n$ as shown in FIG. 2. Alternatively but not shown, core 16 may comprise compression molded insulated iron particles rather than laminated steel plates 50. Core 16 will be described in more detail later.

Now referring again to FIG. 1, primary winding spool 26 is configured to receive and retain primary winding 28. Primary winding spool 26 is disposed adjacent to and radially outward of core 16 and is preferably in coaxial relationship therewith. Primary winding spool 26 may comprise any one of a number of conventional spool configurations known to those of ordinary skill in the art. In the illustrated embodiment, primary winding spool 26 is configured to receive one continuous primary winding. Primary winding spool 26 may be formed generally of electrical insulating material having properties suitable for use in a relatively high temperature environment. For example, primary winding spool 26 may comprise plastic material such as PPO/PS (e.g., NORYL® available from General Electric) or polybutylene terephthalate (PBT) thermoplastic polyester. It should be understood that there are a variety of alternative materials that may be used for primary winding spool 26.

Primary winding 28, as described above, is wound onto primary winding spool 26. Primary winding 28 includes first and second ends that are connected to the primary terminals 40 in LV connector body 38. Primary winding 28 is configured to carry a primary current $I_P$ for charging ignition coil 10 upon control of control unit 12. Primary winding 28 may comprise copper, insulated magnet wire, with a size typically between about 20-23 AWG.

Secondary winding spool 32 is configured to receive and retain secondary winding 34. Secondary winding spool 32 is disposed adjacent to and radially outward of the central components comprising core 16, primary winding spool 26 and primary winding 28 and, preferably, is in coaxial relationship therewith. Secondary winding spool 32 may comprise any one of a number of conventional spool configurations known to those of ordinary skill in the art. In the illustrated embodiment, secondary winding spool 32 is configured for use with a segmented winding strategy where a plurality of axially spaced ribs forms a plurality of channels therebetween for accepting the windings. However, it should be understood that other known configurations may be employed, such as, for example only, a configuration adapted to receive one continuous secondary winding (e.g., progressive winding). Secondary winding spool 32 may be formed generally of electrical insulating material having properties suitable for use in a relatively high temperature environment. For example, secondary winding spool 32 may comprise plastic material such as PPO/PS (e.g., NORYL available from General Electric) or polybutylene terephthalate (PBT) thermoplastic polyester. It should be understood that there are a variety of alternative materials that may be used for secondary winding spool 32.

Encapsulant 30 may be suitable for providing electrical insulation within ignition coil 10. In a preferred embodiment, encapsulant 30 may comprise an epoxy potting material. Sufficient encapsulant 30 is introduced in ignition coil 10, in the illustrated embodiment, to substantially fill the interior of case 36. Encapsulant 30 also provides protection from environmental factors which may be encountered during the service life of ignition coil 10. There are a number of encapsulant materials known in the art.

Secondary winding 34 includes a low-voltage (LV) end and a high-voltage (HV) end. The LV end may be connected to ground by way of a ground connection through LV connector body 38 or in other ways known in the art. The HV end is connected to HV terminal 44, a metal post or the like that may be formed in secondary winding spool 32 or elsewhere. Secondary winding 34 may be implemented using conventional approaches and material (e.g. copper, insulate magnet wire) known to those of ordinary skill in the art.

Figure 3:
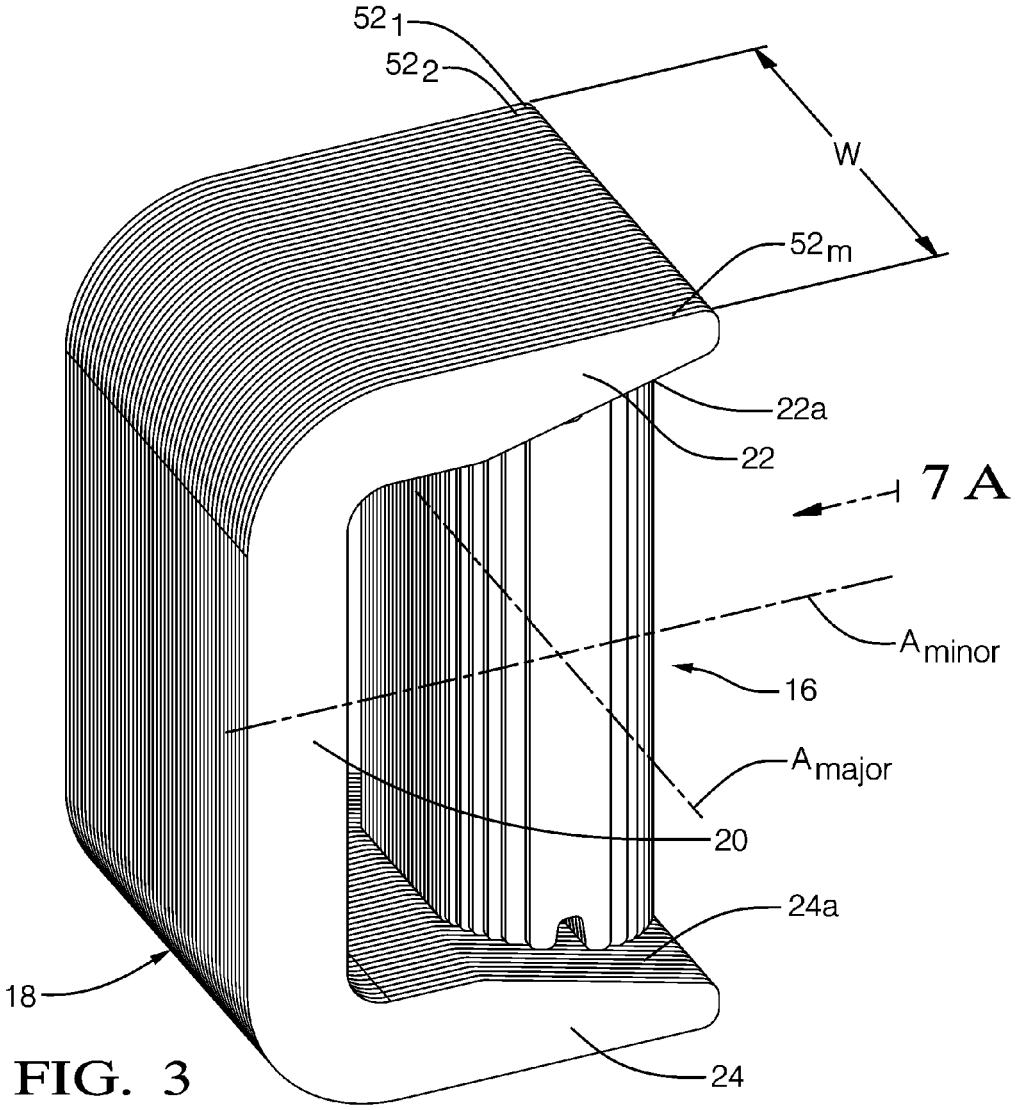
FIG. 3 is and isometric view of a high permeance structure and core of the ignition coil of FIG. 1.

Referring now to FIGS. 1 and 3, high permeance structure 18 is configured to provide a high permeance magnetic return path for the magnetic flux produced in core 16 during operation of ignition coil 10. High permeance structure 18 may be formed, for example, from a lamination stack that includes a plurality of silicon steel laminations $\mathbf{52}_1, \mathbf{52}_2, \ldots \mathbf{52}_m$ or other adequate magnetic material (i.e., magnetically-permeable material), roughly in the form of a C-shape. As described previously, high permeance structure 18 includes base section 20 and a pair of legs 22 and 24. Leg 22 may extend substantially perpendicular from an end of base section 20 that is proximal to upper end surface 46 of core 16 while leg 24 may extend substantially perpendicular from an end of base section 20 that is proximal to lower end surface 48 of core 16. As shown in FIGS. 1 and 3, a face 22*a* of leg 22 that faces the concave portion (faces core 16) of high permeance structure 18 may be tapered from a thicker section that is proximal to base section 20 to a thinner section that is distal from base section 20. Upper end surface 46 of core 16 is tapered to be substantially parallel to face 22*a* of leg 22. Similarly, a face 24*a* of leg 24 that faces the concave portion of high permeance structure 18 may be tapered from a thicker section that is proximal to base section 20 to a thinner section that is distal from base section 20. Lower end surface 48 of core 16 is tapered to be substantially parallel to face 24*a* of leg 24. Alternatively, but not shown, only one of face 22*a* and face 24*a* may be tapered while the other of face 22*a* and face 24*a* may be substantially perpendicular to base section 20. Also alternatively, but not shown, face 22*a* and face 24*a* may both be substantially perpendicular to base section 20.

In the illustrated embodiment, lower end surface 48 of core 16 mates with face 24*a* of leg 24 of high permeance structure 18. Upper end surface 46 of core 16, on the other hand, is spaced apart from the leg 24 by a predetermined distance defining an air gap 54. Core 16, in combination with high permeance structure 18, in view air gap 54, forms a magnetic circuit having a high magnetic permeability. The typical range for air gap 54 is 0.5 mm to 2 mm. To maximize energy stored, air gap 54 should be large enough to keep core 16 from saturating to the normal operating current, or level of ampere-turns (primary current×primary turns).

Figure 4:
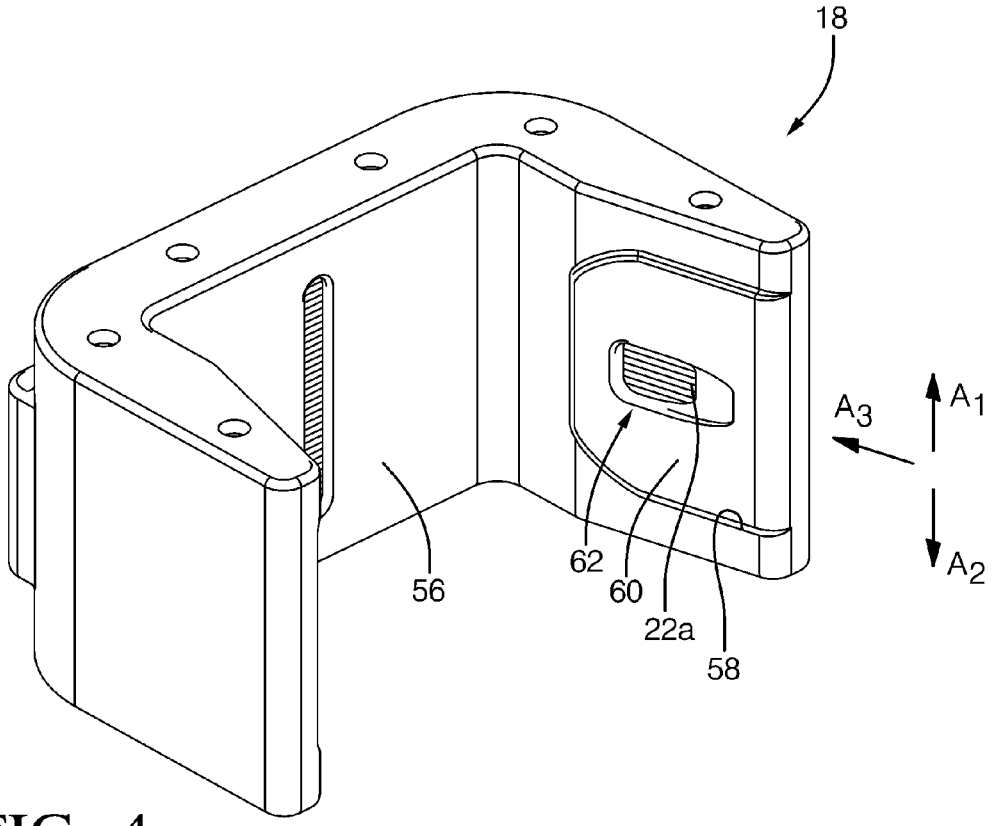
FIGS. 4 and 5 are isometric views of the high permeance structure of FIG. 3 with an over-molding material over-molded thereto.
Figure 5:
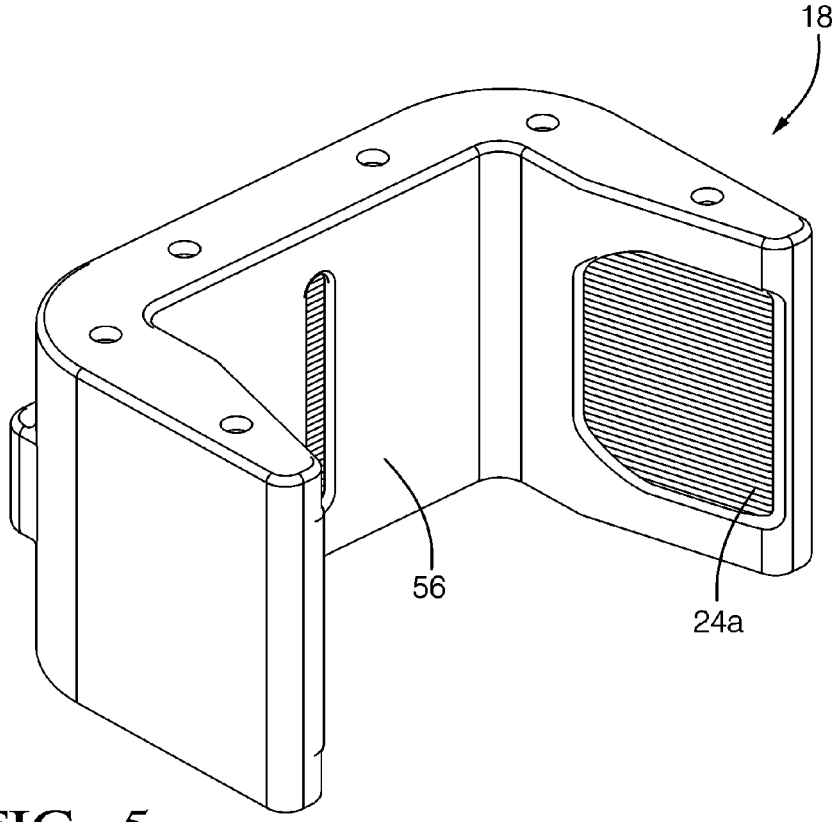

Now referring to FIGS. 1, 4, and 5, high permeance structure 18 may be over-molded with an over-molding material 56 which may be an elastomeric polymer, for example, Hytrel®. While the majority of high permeance structure 18 is covered with over-molding material 56, the portion of face 24*a* of leg 24 which mates with lower end surface 48 of core 16 is not covered with over-molding material 56 because intimate contact between face 24*a* of leg 24 which mates with lower end surface 48 of core 16 is needed. Over-molding material 56 may reduce the stress concentrations in encapsulant 30 at upper end surface 46 of core 16. It should be noted that for clarity, high permeance structure 18 is shown in FIG. 3 without over-molding material 56.

Over-molding material 56 may be formed with lip 58 to aid in holding core 16 in place during assembly. Lip 58 may be shaped to be substantially similar to a portion of the perimeter of upper end surface 46 of core 16 and defines recessed region 60 within which upper end surface 46 of core 16 is received. As shown in FIG. 4, lip 58 is arranged to prevent movement of core 16 (not shown in FIG. 4) in three directions during manufacture as indicated by arrows $A_1, A_2, A_3$. As shown, the three directions indicated by arrows $A_1, A_2, A_3$ lie in a plane defined by recessed region 60. Arrows $A_1, A_2$ are in opposing directions to each other and parallel to the direction in which silicon steel laminations 52 are stacked while arrow $A_3$ points toward base section 20 and is in a direction perpendicular to arrows $A_1, A_2$. Recessed region 60 may include air gap setting window 62 therethrough which exposes a portion of face 22*a* of high permeance structure 18. Air gap setting window 62 is formed with a part of the mold (not shown) which is used to form over-molding material 56 on high permeance structure 18. This allows for a precise thickness of over-molding material 56 on face 22*a* of high permeance structure 18 which is needed for a maintaining air gap 54 at a desired thickness. Air gap setting window 62 may preferably be spaced away from lip 58 and may preferably be substantially centered within recessed region 60 so that core 16 may be supported by recessed region 60 around the perimeter of core 16. While lip 58 has been described to be shaped to be substantially similar to a portion of the perimeter of upper end surface 46 of core 16 and defines recessed region 60 within which upper end surface 46 of core 16 is received, it should now be understood that the shape of lip 58 need not be substantially similar to a portion of the perimeter of upper end surface 46 of core 16, but rather may be shaped substantially different, but sized to substantially prevent movement of core 16 in the direction of arrows $A_1$, $A_2$, $A_3$. For example only, while core 16 is substantially oval in cross-sectional shape, lip 58 may be substantially rectangular in shape.

Figure 6:
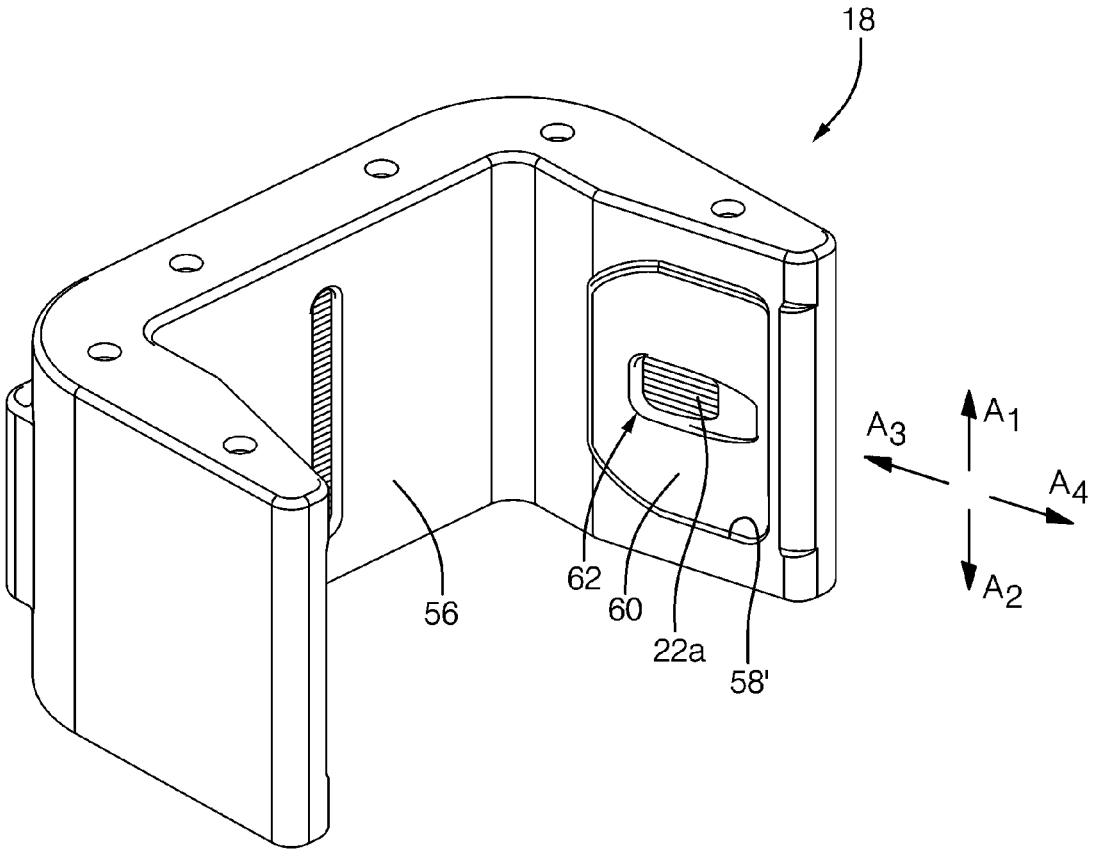
FIG. 6 is an isometric view of a second embodiment of a high permeance structure with an over-molding material.

Alternatively, lip 58 may be modified as indicated by lip 58' shown in FIG. 6. Lip 58' differs from lip 58 in that lip 58' completely surrounds core 16 (not shown in FIG. 6) and is shaped to be substantially similar to the entire perimeter of upper end surface 46 of core 16. In this way, lip 58' not only prevents movement in the three directions indicated by arrows $A_1$, $A_2$, $A_3$, but also a fourth direction $A_4$ which is in the opposite direction as arrow $A_3$. While lip 58' has been described to be shaped to be substantially similar to the entire perimeter of upper end surface 46 of core 16 and defines recessed region 60 within which upper end surface 46 of core 16 is received, it should now be understood that the shape of lip 58' need not be substantially similar to a portion of the perimeter of upper end surface 46 of core 16, but rather may be shaped substantially different, but sized to substantially prevent movement of core 16 in the direction of arrows $A_1$, $A_2$, $A_3$, $A_4$. For example only, while core 16 is substantially oval in cross-sectional shape, lip 58 may be substantially rectangular in shape.

As can be seen in FIGS. 4, 5, and 6; there are additional openings through over-molding material 56 that exposes other areas of high permeance structure 18 besides portions of face 22*a* and face 24*a*. As oriented in FIGS. 4 and 6, silicon steel lamination $\mathbf{52}_m$ (numbered in FIG. 3) is exposed through six circular shaped openings (not numbered) through over-molding material 56. Similarly, as oriented in FIG. 5, silicon steel lamination $\mathbf{52}_1$ (numbered in FIG. 3) is exposed through six circular shaped openings (not numbered) through over-molding material 56. FIGS. 4, 5, and 6 also show that several silicon steel laminations 52 (numbered in FIG. 3) are exposed at base section 20 through an elongated opening (not numbered) through over-molding material 56. It should be noted that the circular openings exposing portions of silicon steel lamination $\mathbf{52}_1$ and silicon steel lamination $\mathbf{52}_m$ and the elongated opening exposing several silicon steel laminations 52 at base section 20 do not serve a function in completed ignition coil 10, but are the result of the over-molding process used to apply over-molding material 56 to high permeance structure 18. Over-molding material 56 is applied to high permeance structure 18 by a conventional over-molding process in which high permeance structure 18 is placed in a mold (not shown) and over-molding material 56 in liquid form is injected into the mold, thereby filling the void between the mold and high permeance structure 18. In this case, the mold that is used includes features that contact high permeance structure 18 to keep high permeance structure precisely positioned in the mold to accurately apply over-molding material 56. Over-molding material 56 is allowed to solidify and the mold is removed to reveal high permeance structure 18 that is substantially over-molded with over-molding material 56.

Figure 7A:
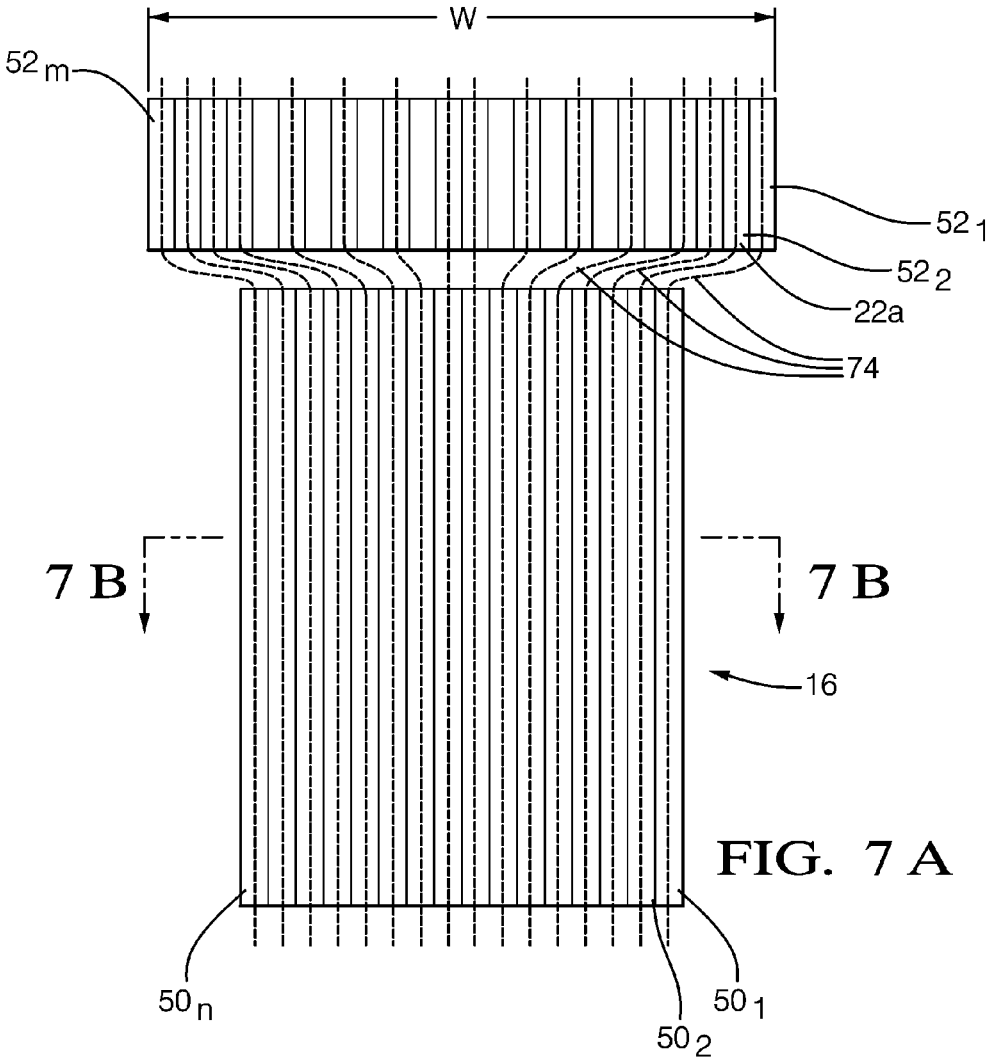
FIG. 7A is an elevation view of a portion of the high permeance structure and core of FIG. 3 in the direction of arrow 7A.
Figure 7B:
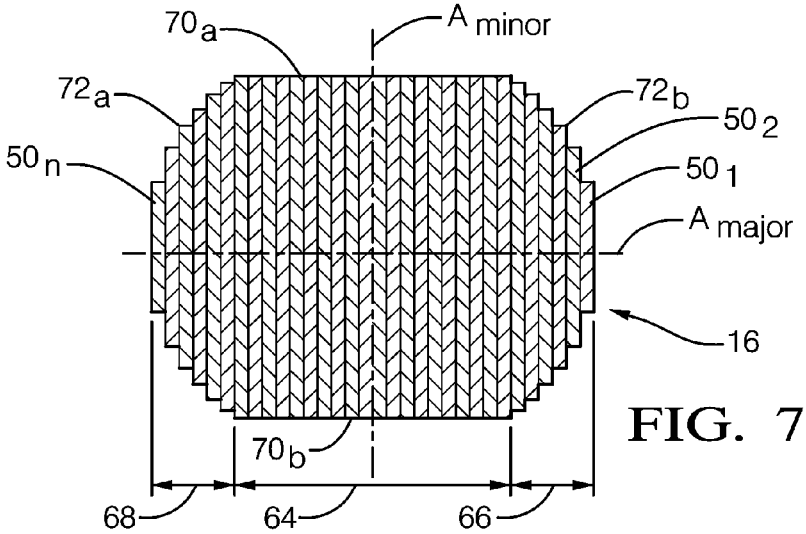
FIG. 7B is a radial cross-section view of the core of FIG. 7A.

Reference will now be made to FIGS. 3, 7A, and 7B where FIG. 7A is a view in the direction of arrow 7A of FIG. 3 of a portion of core 16 and leg 22 of high permeance structure 18 and FIG. 7B is a radial cross-section view of core 16. As described previously, core 16 is preferably generally oval in overall radial cross-sectional shape. Accordingly, core 16 includes major axis $A_{major}$ and minor axis $A_{minor}$. Major axis $A_{major}$ extends in the direction across the radial cross-section of core 16 defined by each laminated steel plate $\mathbf{50}_1$-$\mathbf{50}_n$ while minor axis $A_{minor}$ extends in the direction across the radial cross-section of core 16 which is perpendicular to major axis $A_{major}$. Major axis $A_{major}$ also extends in the same direction as the width W (parallel to the direction in which silicon steel laminations 52 are stacked) of high permeance structure 18 which is the sum of the thicknesses of silicon steel laminations $\mathbf{52}_1$-$\mathbf{52}_m$. The generally oval shape of core 16 is accomplished by varying the width of each laminated steel plate $\mathbf{50}_1$-$\mathbf{50}_n$ in the direction of minor axis $A_{minor}$. As shown in FIG. 7B, a core middle section 64 may have laminated steel plates of common width in the direction of minor axis $A_{minor}$ while a first core end section 66 and a second core end section 68 have laminated steel plates of decreasing width from core middle section 64 to laminated steel plates $\mathbf{50}_1$ and $\mathbf{50}_n$ respectively. This arrangement produces a generally oval or racetrack shape with straight sides 70*a*, 70*b* that are parallel to each other and connected at each end by arcuate ends 72*a*, 72*b* that oppose each other.

Figure 8A:
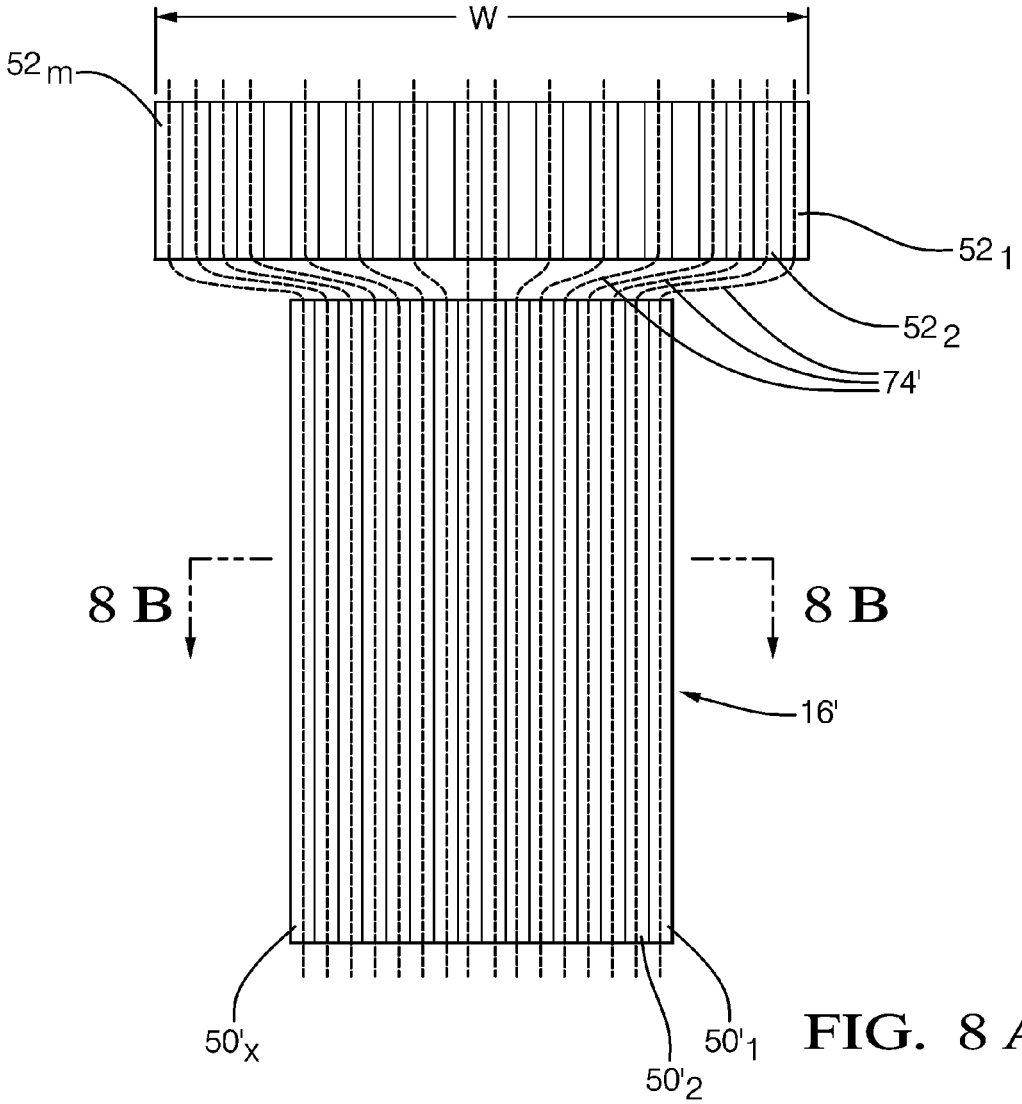
FIG. 8A is a cross-section view similar to the cross-section view of FIG. 7A except with a core having a circular cross-sectional shape.
Figure 8B:
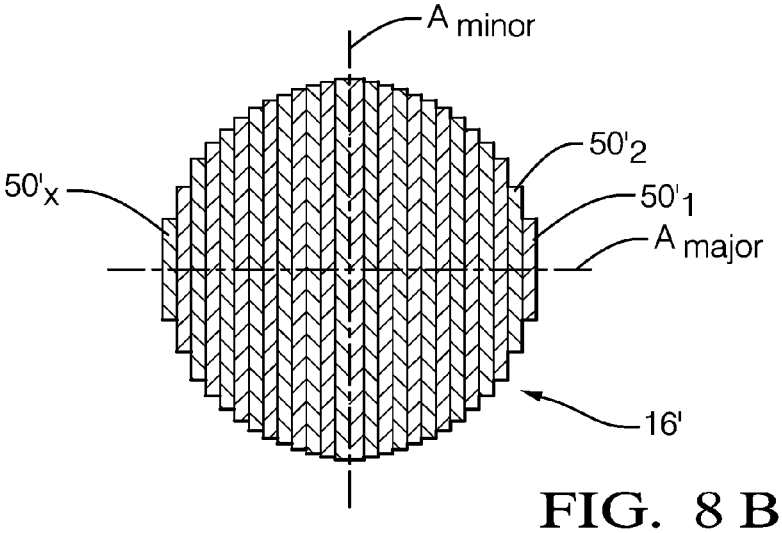
FIG. 8B is a cross-section view of the core of FIG. 8A.

Reference will now be made to FIGS. 8A and 8B where FIG. 8A is a view similar to that of FIG. 7A except that core 16 is replaced with core 16' which is generally circular in radial cross-sectional shape and FIG. 8B is a radial cross-section view of core 16'. Core 16' includes laminated steel plates $\mathbf{50'}_1$, $\mathbf{50'}_2$, . . . $\mathbf{50'}_x$.

In order to maintain the same overall packaging size of the ignition coil when using generally circular core 16', the dimension of core 16' in the same direction as width W of high permeance structure 18 must be decreased in comparison to core 16. This may be most readily visible in FIG. 3 which includes core 16. If the dimension of core 16 along major axis $A_{major}$ is held constant and the dimension of core 16 along minor axis $A_{minor}$ is adjusted to produce substantially circular core 16' as shown in FIG. 8B, the core would extend beyond leg 22 and leg 24 of high permeance structure 18, thereby increasing the overall packaging size of ignition coil 10. Referring now to FIGS. 7B and 8B, the overall packaging size of the ignition coil is maintained by having the dimension of core 16' along axis $A'_{minor}$ the same as the dimension of core 16 along axis $A_{minor}$. However, the dimension of core 16' along axis $A'_{major}$ is decreased (in comparison to the dimension of core 16 along axis $A_{major}$) to be the same dimension as the dimension of core 16' along axis $A'_{minor}$, thereby making core 16' substantially circular in cross-section.

Now referring to FIGS. 7A and 8A, the benefit of the radial cross-section shape of core 16 over core 16' can be appreciated by a comparison of flux lines 74 shown in FIG. 7A and flux lines 74' shown in FIG. 8A. As can be seen in FIG. 8A, flux lines 74' that are near laminated steel plates $\mathbf{50'}_1$, $\mathbf{50'}_x$ and silicon steel laminations $\mathbf{52}_1$, $\mathbf{52}_m$ are approaching being perpendicular to laminated steel plates 50' and silicon steel laminations 52 which increases flux loss due to an increase of eddy currents. Also as can be seen in FIG. 7A, flux lines 74 that are near laminated steel plates $\mathbf{50'}_1$, $\mathbf{50'}_n$ and silicon steel laminations $\mathbf{52}_1$, $\mathbf{52}_m$ do not approach being perpendicular to laminated steel plates 50 and silicon steel laminations 52 to the same extent as in FIG. 8A which uses substantially circular core 16'. Flux lines 70 being more close to paralleling laminated steel plates 50 and silicon steel laminations 52 near laminated steel plates 50'1, 50'*n* and silicon steel laminations $\mathbf{52}_1$, $\mathbf{52}_m$ reduces flux loss due to a decrease in eddy currents.

While core 16 has been described as being generally oval in overall shape in radial cross-section, it should now be understood that core 16 may take the form of other non-circular shapes in radial cross-section. For example only, core 16 may be rectangular, hexagonal, or octagonal. Preferably, regardless of shape, the dimension of core 16 along axis $A_{major}$ is greater than the dimension of core 16 along axis $A_{minor}$.

While this invention has been described in terms of preferred embodiments thereof, it is not intended to be so limited, but rather only to the extent set forth in the claims that follow.

We claim:

1. An ignition coil for an internal combustion engine, comprising:

a magnetically-permeable core extending along a core longitudinal axis, said core having a pair of end surfaces on axially-opposite ends thereof;

a primary winding disposed outward of said core;

a secondary winding disposed outward of said primary winding; and a structure comprising magnetically-permeable steel laminations having a base and a pair of legs, said structure defining a magnetic return path;

wherein said core is disposed between said pair of legs whereby said core longitudinal axis extends through said legs and said end surfaces face toward said legs and at least one of said end surfaces of said core is spaced apart from a respective one of said legs to define an air gap, and wherein said structure is over-molded with an over-molding material whereby said over-molding material fills at least a portion of said air gap.

2. An ignition coil as in claim 1 wherein said over-molding material is an elastomeric polymer.

3. An ignition coil as in claim 1 wherein said over-molding material defines a recessed region within which said at least one of said end surfaces of said core is received.

4. An ignition coil as in claim 3 wherein said recessed region includes an air gap setting window through said over-molding material to expose said structure.

5. An ignition coil as in claim 3 wherein said recessed region is located on one of said legs.

6. An ignition coil as in claim 3 wherein said recessed region is defined by a lip.

7. An ignition coil as in claim 6 wherein said lip follows a portion of the perimeter of said at least one of said end surfaces of said core.

8. An ignition coil as in claim 6 wherein said lip substantially prevents movement in three directions in a plane defined by said recessed region;

wherein a first direction of said three directions is parallel to a width of said structure, said width being defined by the sum of said steel laminations;

wherein a second direction of said three directions is opposite to said first direction; and wherein a third direction of said three directions is perpendicular to said first and second directions and in a direction toward said base.

9. An ignition coil and in claim 8 wherein said lip prevents movement of said core in a fourth direction in said plane, wherein said fourth direction is opposite to said third direction.

10. An ignition coil as in claim 1 wherein said core has a radial cross-section that is non-circular in shape.

11. An ignition coil as in claim 10 wherein said core is substantially oval in radial cross-section.

12. An ignition coil as in claim 10 wherein the sum of said steel laminations defines a width of said structure and wherein said core includes:

a major axis perpendicular to said core longitudinal axis and parallel to said width of said structure; and a minor axis perpendicular to said core longitudinal axis and perpendicular to said major axis;

wherein a dimension of said core along said major axis is greater than a dimension of said core along said minor axis.

13. An ignition coil as in claim 1 wherein at least one of said legs includes a face that faces toward said core and is tapered from a thicker section that is proximal to said base to a thinner section that is distal from said base.

14. An ignition coil as in claim 1 wherein each of said legs include a face that is that faces toward said core and is tapered from a thicker section that is proximal to said base to a thinner section that is distal from said base.

15. An ignition coil as in claim 14 wherein said face of one of said legs is free of said over-molding material such that said core is in intimate contact with said face.

16. An ignition coil as in claim 15 where said face of the other of said legs includes said over-molding material that fills at least said portion of said air gap.

17. An ignition coil for an internal combustion engine, comprising:

a magnetically-permeable core extending along a core longitudinal axis, said core having a non-circular shape in radial cross-section and having a pair of end surfaces on axially-opposite ends thereof;

a primary winding disposed outwardly of said core;

a secondary winding disposed outwardly of said primary winding; and a structure comprising magnetically-permeable steel laminations having a base and a pair of legs, said structure defining a magnetic return path;

wherein said core is disposed between said pair of legs whereby said core longitudinal axis extends through said legs and said end surfaces face toward said legs and at least one of said end surfaces of said core is spaced apart from a respective one of said legs to define an air gap, and wherein said structure is over-molded with an over-molding material whereby said over-molding material fills at least a portion of said air gap.

18. An ignition coil as in claim 17 wherein said core has a substantially oval shape in radial cross-section.

19. An ignition coil as in claim 18 wherein said substantially oval shape in radial cross-section includes a pair of straight sides that are parallel to each other and connected at each end by arcuate ends that oppose each other.

* * * * *